United States Patent [19]

Kazui et al.

[11] Patent Number: 4,878,275

[45] Date of Patent: Nov. 7, 1989

[54] SEPARABLE SLIDE FASTENER

[75] Inventors: Hidetaka Kazui, Compton, Calif.; Tomiyoshi Takano, Kurobe, Japan

[73] Assignee: Yoshida Kogyo K. K., Tokyo, Japan

[21] Appl. No.: 97,816

[22] Filed: Sep. 17, 1987

[51] Int. Cl.[4] ..... A44B 19/36

[52] U.S. Cl. ..... 24/436; 24/388

[58] Field of Search ..... 24/387, 388, 436, 435

[56] References Cited

U.S. PATENT DOCUMENTS

| | | | |
|---|---|---|---|
| 1,918,779 | 7/1933 | Prentice | 24/436 |
| 2,044,161 | 6/1936 | Forster | 24/436 |
| 2,190,609 | 2/1940 | Farnstrom | 24/388 |
| 2,193,827 | 3/1940 | Marinsky . | |
| 2,267,384 | 12/1941 | Waldes | 24/388 |
| 2,332,923 | 10/1943 | Lohse | 24/436 |
| 2,423,202 | 7/1947 | Morin | 24/436 X |
| 4,034,445 | 7/1977 | Stephens | 24/436 |
| 4,045,845 | 9/1977 | Kando | 24/436 |
| 4,109,349 | 8/1978 | Tanaka | 24/436 |
| 4,223,425 | 9/1980 | Akashi | 24/388 X |

FOREIGN PATENT DOCUMENTS 60-12909 7/1985 Japan .

*Primary Examiner*—James R. Brittain

*Attorney, Agent, or Firm*—Hill, Van Santen, Steadman & Simpson

[57] ABSTRACT

A top end stop of one of opposed fastener stringers of a separable slide fastener has an obtusely angled configuration composed of longitudinally continuous and integral first and second half parts. Each of the first and second half parts has a maximum width equal to or slightly smaller than the width of each branch of a Y-shaped guide channel of a slider so that the top end stop can pass through the guide channel branch as it is moved in a C-shaped path. The top end stop has a maximum width, as measured perpendicularly to an inner longitudinal edge of the tape, larger than the width of the guide channel branch, and hence cannot pass through the guide channel branch as it is moved simply in a straight path.

3 Claims, 4 Drawing Sheets

SEPARABLE SLIDE FASTENER

BACKGROUND OF THE INVENTION

1. Field of the Invention

The present invention relates to slide fasteners, and more particularly to a separable slide fastener.

2. Description of the Prior Art

In separable slide fasteners of the type in which a pair of top end stops is to be substantially completely received in a pair of branches of a Y-shaped guide channel in a slider when the latter is moved all the way up to fully close the slide fastener, there was a problem that the slider would be accidentally removed from one fastener stringer after the latter has been separated from the other fastener stringer. To this end, solutions have been proposed in U.S. Pat. No. 2,193,827 and Japanese Patent Laid-Open Publication (Kokai) No. 60-112909, for example.

According to the solution disclosed in U.S. Pat. No. 2,193,827, each top end stop has on its upper surface a projection, and the slider has in an inside surface of the respective branch of the Y-shaped channel a dead-end groove opening to the front end of the slider for slidably receiving the projection of the respective top end stop so as to restrict downward or rearward movement of the respective top end stop through the slider. This prior art slide fastener is disadvantageous in that the slider cannot be removed from the fastener stringers even when it is necessary for replacement with another or for facilitating attachment of the fastener stringers to a garment.

According to the solution disclosed in Japanese Patent Laid-Open Publication No. 61-112909, the slider has at its flaring front end of the Y-shaped guide channel chamferred surfaces, and each top end stop is made of synthetic resin and has at least one integral projection engageable with the chamferred surfaces. The projection is resiliently deformable as compressed by the chamferred surfaces when the slider is pulled forwardly over the top end stop with relatively great force. With this resiliently deformable projection, the top end stop is not only prevented from accidental removal from the fastener stringer but also allowed to be removed therefrom when necessary for replacement or other purposes. A problem with this prior art slide fastener is that the projection is relatively large in height in order to secure safety from accidental removal, causing an increased degree of friction between the slider and the top end stop while the latter is moved through one branch of the guide channel. With this increase of the friction, easy removal of the slider is difficult to achieve. Further, the material for the top end stops of this prior art slide fastener is limited to a special synthetic resin having a good resiliency.

SUMMARY OF THE INVENTION

It is therefore an object of the invention to provide a separable slide fastener in which a slider is prevented from accidental removal from one fastener stringer over a top end stop but is allowed to be removed smoothly without any deformation of the top end stop when it is necessary for replacement or other purposes.

According to the invention, a top end stop on one of opposed fastener stringers of a separable slide fastener has an obtusely angled configuration, as viewed in plan, composed of longitudinally continuous and integral first and second half parts. Each of the first and second half parts has a maximum width equal to or slightly smaller than the width of each branch of a Y-shaped guide channel in a slider, so that the top end stop can pass through one of the branches of the guide channel as it is moved in a C-shaped path. The top end stop has a maximum width, as measured perpendicularly to an inner longitudinal edge of one stringer tape, larger than the width of the branch of the guide channel and hence cannot pass through the guide channel branch as it is moved simply in a straight path.

Many other objects, advantages and additional features of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
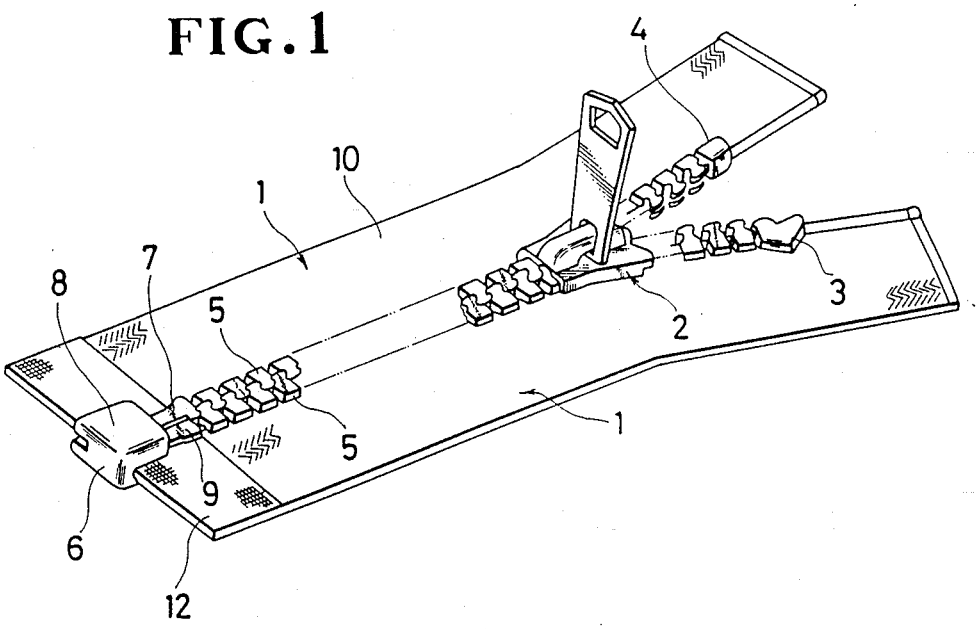
FIG. 1 is a perspective view of a separable slide fastener embodying the present invention.
Figure 2:
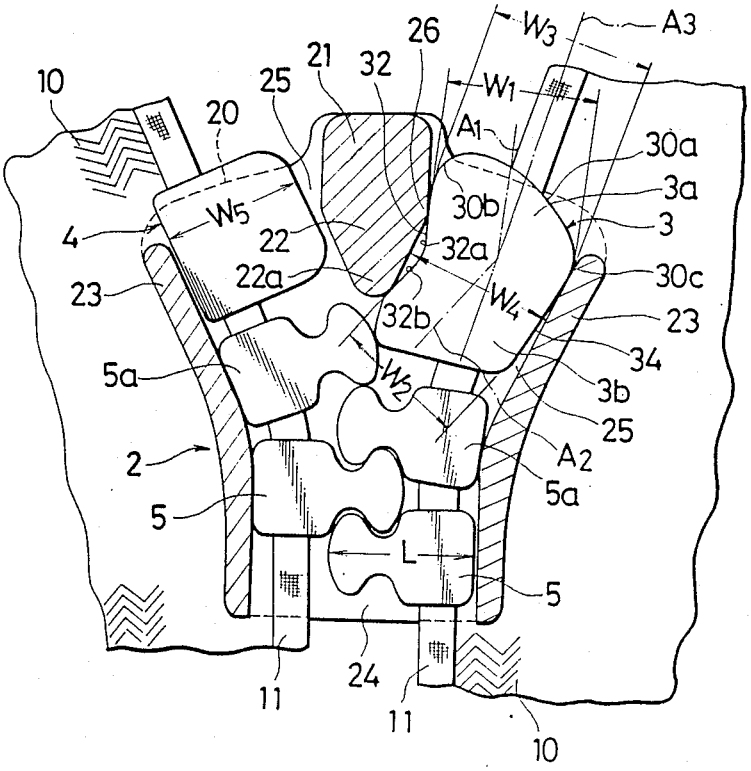
FIG. 2 is an enlarged fragmentary plan view, partially in cross section, of the slide fastener, showing a pair of top end stops received in a slider.

The principle of the present invention is particularly useful when embodied in a separable slide fastener such as shown in FIGS. 1 and 2.

The slide fastener generally comprises a pair of fastener stringers 1, 1 including a pair of stringer tapes 10, 10 and a pair of rows of fastener elements 5, 5 mounted on the stringer tapes 10, 10 along their respective inner longitudinal (beaded) edges 11, 11, and a slider 2 threaded on the pair of fastener stringers 1, 1 for movement along the pair of rows of fastener elements 5, 5 to close and open the slide fastener.

A separable bottom-end-stop assembly 6 (FIG. 1) is mounted on adjacent bottom ends of the fastener stringers 1, 1 at the respective bottom end portions of the confronting beaded tape edges 11, 11. The bottom-end-stop assembly 6 includes a first pin member 9 secured to the bottom end portion of one of the confronting beaded tape edges 11, a second pin member 7 secured to the bottom end portion of the other beaded tape edge 11, and a socket member 8 secured to the first pin member 9. The socket member 8 has a bore (not shown) in which the second pin member 7 is releasably inserted. A pair of reinforcing film pieces 12, 12 is attached to opposite surfaces of each stringer tape 10 at the bottom end portion thereof.

A pair of top end stops 3, 4 is mounted on the respective beaded tape edges 11, 11 contiguous to the topmost coupling elements *5a, 5a* (FIG. 2).

As shown in FIG. 2, the slider 2 includes a slider body having a wedge-shaped neck 21 disposed centrally at a flared front end 20 thereof, and a pair of flaring side flanges 23, 23 disposed along opposite sides of the slider 2 to define with the neck 21 a Y-shaped guide channel 24 for passage of the second pin member 7, the top end stops 3, 4 as well as the fastener element rows 5,5.

Important, one of the top end stops 3 (hereinafter referred to as "first top end stop") has an obtusely angled configuration (as viewed in plan) having an inner recessed surface 32. The first top end stop 3 is composed of longitudinally continuous and integral first and second half parts 3*a*, 3*b*. The axis A1 of the first half part 3*a* is inwardly inclined an angle of about 13° with respect to the axis A3 of the entire first top end stop 3. The axis A2 of the second half part 3*b* is inwardly inclined an angle of about 20° with respect to the axis A3 of the entire first top end stop 3. The axis A3 extends along the centerline of the beaded tape edge 11. The axis A1 extends substantially parallel to an upper half portion 32*a* of the inner recessed surface 32, while the axis A2 extends substantially parallel to a lower half portion 32*b* of the inner recessed surface 32.

Most important, each of the first and second half part 3*a*, 3*b* has a maximum width W1, W2 equal to or slightly smaller than the width W4 of each branch 25 of the guide channel 24. The width W4 is a distance between a tapered portion 22 of the neck 21 and one of the flaring side flanges 23. The maximum width W3 of the entire first top end stop 3, as measured perpendicularly to the beaded tape edge 11, is larger than the width W4 of each branch 25 of the guide channel 24.

The first half part 3*a* has an arcuate front surface 30*a* joined at opposite ends with the inner recessed surface 32*a* and an outer side surface 34 of the second half part 3*b* by a pair of chamferred surfaces 30*b*, 30*c*, respectively.

The other top end stop 4 (hereinafter referred to as "second top end stop"), unlike the first top end stop 3, is a generally square configuration having a maximum width W5 equal to the length L of the fastener elements 5 and slightly smaller than the width W4 of each branch 25 of the guide channel 24.

FIG. 2 shows the slider 2 having been moved all the way up to fully close the slide fastener, in which the first top end stop 3 (on one fastener stringer 1) is in contact with the topmost fastener element 5*a* on the other fastener stringer 1 which element in turn is simply in contact with the topmost fastener element 5*a* on the one fastener stringer 1. That is, at that time the two topmost fastener elements 5*a*, 5*a* are not interengaged as yet. With this arrangement, smooth start of the movement of the slider 2 to open the slide fastener can be achieved.

Although the second to end stop 4, unlike the first top end stop 3, does not actually serve as a top end stop but only as an ornament, the second top end stop 4 may have a shape symmetric to the shape of the second top end stop 3. Alternatively, the second top end stop 4 may be extended to the topmost fastener element 5*a*. Further, the second top end stop 4 may be displaced toward the bottom end of the fastener stringer 1 by one pitch, with the topmost fastener element 5*a* of FIG. 2 omitted, in which arrangement the first and second top end stops 3, 4 are staggered by a half pitch.

Figure 3A:
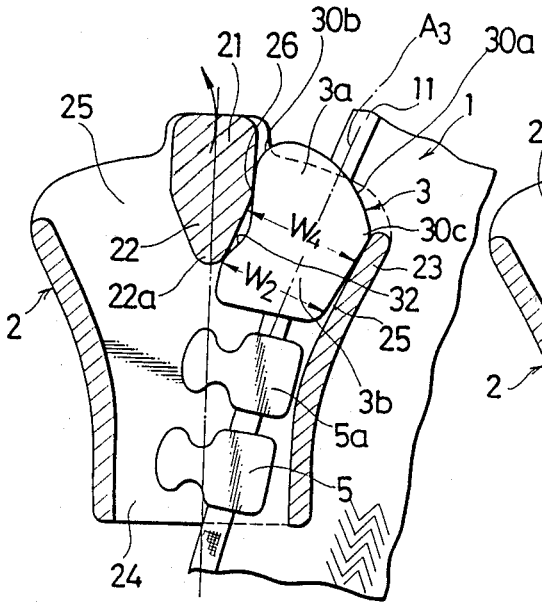
FIGS. 3A through 3C illustrate the manner in which the slider is removed from one fastener stringer.

FIG. 3A shows one fastener stringer 1 which has been separated from the other fastener stringer 1 in a manner well known in the art and in which the slider 2 has been moved all the way up to the first top end stop 3 by pulling the slider 2 simply in a straight path. At that time, because the maximum width W2 of the second half part 3*b* of the first stop end stop 3 is smaller than the width W3 of the branch 25 of the guide channel 24, the first top end stop 3 is inserted into the guide channel branch 25 smoothly, with the axis A3 of the first top end stop 3 substantially parallel to the centerline of the guide channel branch 25, until the first half part 3*a* of the first top end stop 3 is blocked at the front end of the guide channel branch 25.

Figure 3B:
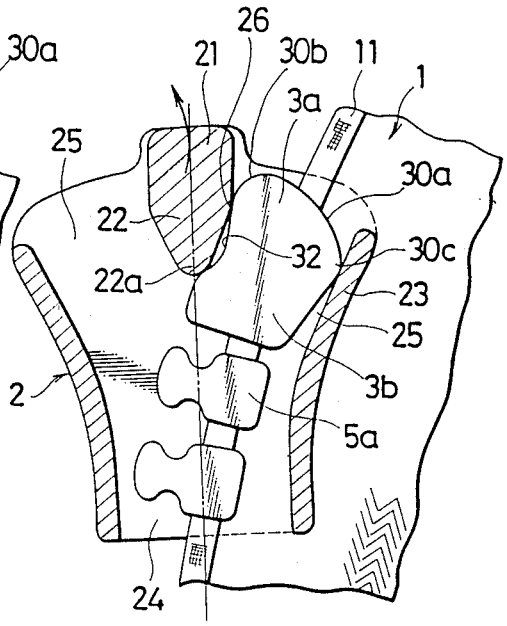
Figure 3C:
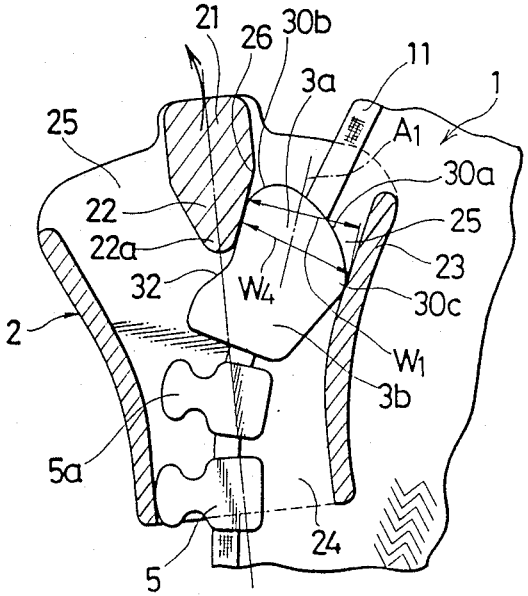

Then the slider 2 is turned counterclockwise (in the general plane of the stringer 1) in such a manner that a distal end 22*a* of the tapered portion 22 of the neck 21 and an intermediate peak 26 of the neck 21 slide on the inner recessed surface 32 while the chamferred surface 30*c* slides on the inside surface of the flaring side flange 23 of the slider 2 as shown in FIGS. 3B and 3C. At that time, partly because the axis A1 of the first half part 3*a* is caused to be substantially parallel to the centerline of the guide channel branch 25, and partly because the maximum width W1 of the first half part 3*a* is equal to or slightly slightly smaller than the width W4 of the guide channel branch 25, the first half part 3*a* is inserted into the guide channel branch 25 smoothly. With continued pulling of the slider 2, the first top end stop 3 passes all the way through the guide channel branch 25 and the main guide channel 24. As a result, the slider 2 has been removed from the fastener stringer 1 over the first top end stop 3.

Figure 4A:
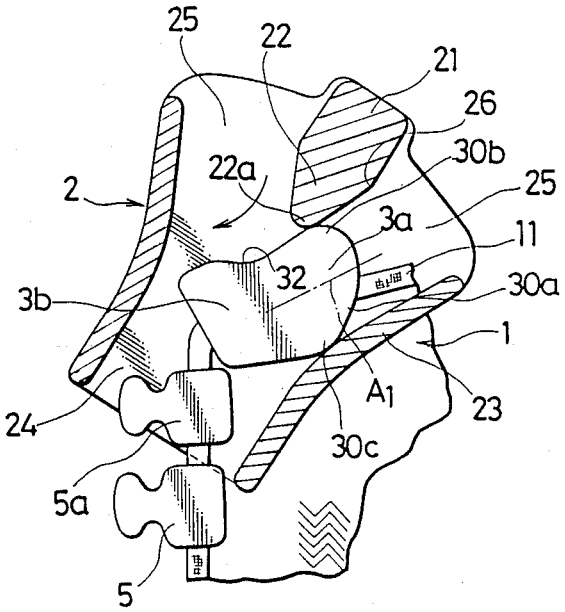
FIGS. 4A through 4E illustrate the manner in which the slider is threaded onto one fastener stringer.
Figure 4B:
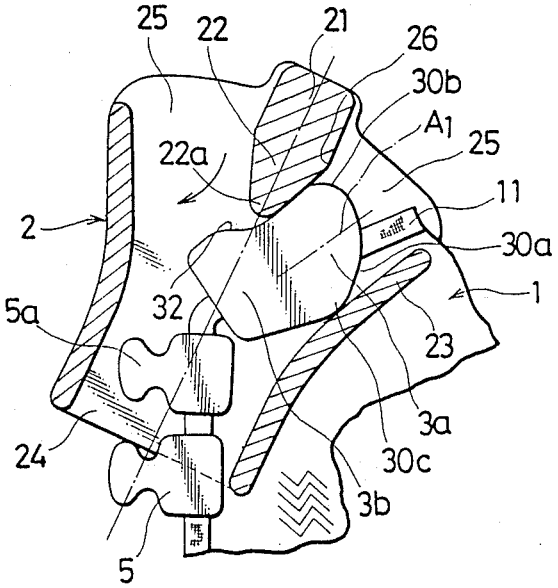

For threading the slider 2 onto one fastener stringer 10, the first half part 3*a* is smoothly inserted into the guide channel branch 25 from the rear end of the slider 2, with the axis A1 of the first half part 3*a* substantially parallel to the centerline of the guide channel branch 25, as shown in FIGS. 4A and 4B.

Figure 4C:
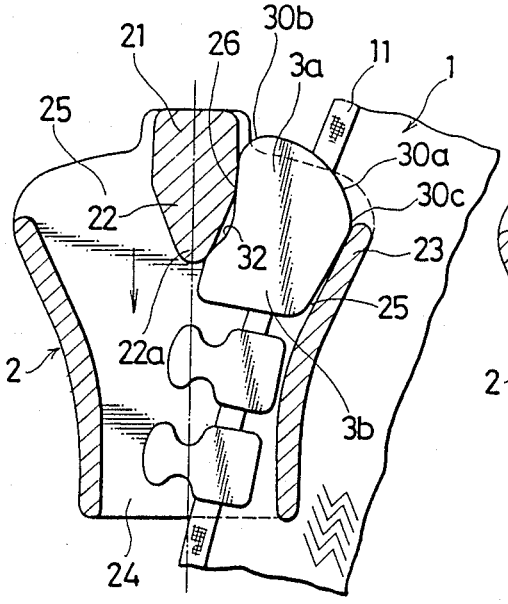
Figure 4D:
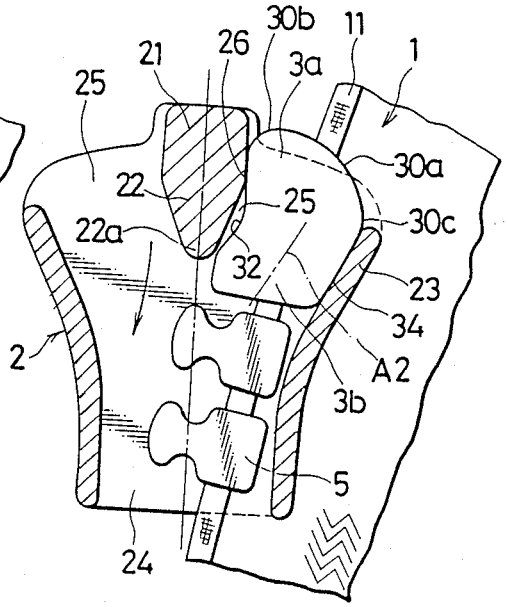
Figure 4E:
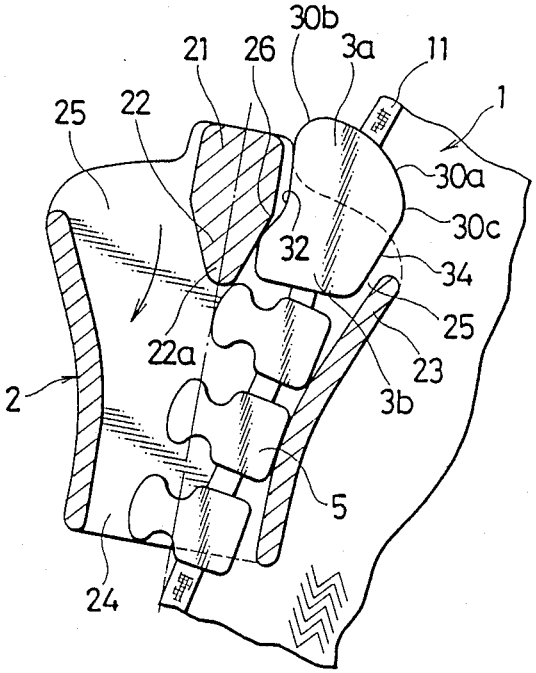

Then the slider 2 is turned clockwise in some degree in such a manner that the distal end 2*a* of the tapered portion 22 of the neck 21 and the intermediate peak 26 of the neck 21 slide on the inner recessed surface 32 while the chamferred surface 30*c* slides on the inside surface of the flaring side flange 23 of the slider 2, as shown in FIGS. 4C through 4E. This clockwise turning of the slider 2 causes the axis A2 of the second half part 3*b* to be substantially parallel to the centerline of the guide channel branch 25 and then to be inserted into the guide channel branch 25 smoothly. With continued pulling of the slider 2 toward the bottom end of the fastener stringer 1, the first top end stop 3 passes all the way through the guide channel branch 25 and the main guide channel 24. As a result, the slider 2 has been threaded onto the fastener stringer 1 over the first top end stop 3.

As shown in FIGS. 3A, 3B, 4C and 4D, during the passing of the first top end stop 3 through the guide channel branch 25 of the slider 2, the recessed surface 32 of the first top end stop 3 engages the intermediate peak 26 of the neck 2 and also the distal end 22*a* of the tapered portion 22 of the neck 21 and the chamferred surface 30*c* of the first top end stop 3 engages the inside surface of the flaring side flange 23 of the slider 2. Thus the first top end stop 2 is supported between the neck 21 and the flaning side flange 23 at three points. Because of this three-point engagement, the slider 2 is kept reliably from being inadvertently removed from the one fastener stringer 1 even if the latter is waved violently. Also, this three-point engagement enables easy threading and removing of the slider 2 onto and out of the fastener stringer 1 over the first top end stop 3, if necessary.

According to the present invention, since the maximum width W1, W2 of each of the first and second half part 3*a*, 3*b* of the obtusely angled (as viewed in plan) first top end stop 3 is equal to or smaller than the width W4 of the guide channel branch 25, the first top end stop 3 can pass through the guide channel branch 25 from either end thereof with virtually no considerable resistance as it is moved in a C-shaped path. During that time no resilient deformation of any part of the first top end stop 3 would occur. Therefore the first top end stop 3 may be made of either synthetic resin or metal.

Further, since the maximum width W3 of the entire first top end stop 3 as measured perpendicularly to the centerline of the beaded tape edge 11 is larger than the width W4 of the guide channel branch 25, the first top end stop 3 cannot pass through the guide channel branch 25 as long as the axis A3 of the entire first top end stop 3 is kept substantially parallel to the centerline of the guide channel branch 25.

Figure 5:
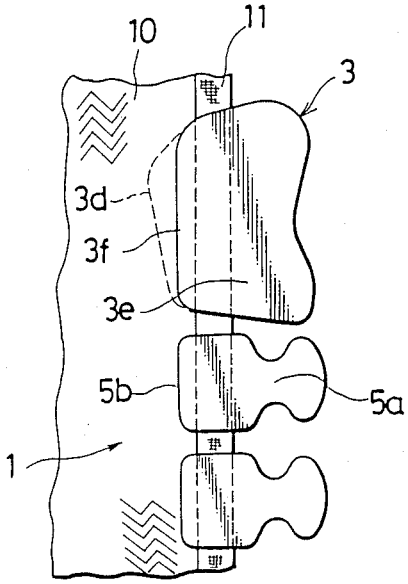
FIG. 5 is an enlarged fragmentary bottom view of the fastener stringer of FIGS. 3A–3C and 4A–4E, showing the underside of one top end stop.

As shown in FIG. 5, the first top end stop 3 is composed of integral front and rear side portions **3*d*, 3*e* disposed one on each side of the stringer tape 10. The rear side portion 3*e* has a width substantially equal to the length L of the fastener elements 5, and has an outer flat surface 3*f* substantially flush with the sole portions 5*b* of the fastener elements 5. In general, at the final or finishing stage of the manufacture of a separable slide fastener, it is customary that a continuous slide fastener chain is guided by a guide means in a slide-fastener finishing apparatus where attaching of the reinforcing film strips 12, attaching of parts of the separable bottom-end-stop assebly 6, cutting of the slide fastener chain, and threading of the slider 2, for example, take place. This configuration of the rear side portion 3*e*** serves to assist in guiding the slide fastener chain accurately while it is processed in such slide-fastener finishing apparatus.

Although various minor modifications may be suggested by those versed in the art, it should be understood that we wish to embody within the scope of the patent granted hereon, all such embodiments as reasonably and properly come within the scope of our contribution to the art.

What is claimed is:

1. A separable slide fastener, comprising:

(a) a pair of fastener stringers each including a pair of stringer tapes and a pair of rows of fastener elements mounted on said stringer tapes along respective inner longitudinal edges thereof;

(b) a slider threaded on said pair of rows of fastener elements for movement therealong to close and open the slide fastener, said slider including a slider body having a wedge-shaped neck disposed centrally at a flared front end thereof and a pair of flaring side flanges disposed along opposite sides of said slider to define with said neck a Y-shaped guide channel for passage of said pair of rows of fastener elements, said guide channel having a pair of branches diverging toward said front end of said slider, said wedge-shaped neck having at its lower end a distal end and at its opposite sides respective intermediate peaks;

(c) a separable bottom-end-stop assembly mounted on adjacent bottom ends of said fastener stringers; and (d) a top end stop mounted on said inner longitudinal edge of one of said stringer tapes, said top end stop having a maximum width (W3), as measured perpendicularly to said inner longitudinal edge of said one stringer, larger than the width (W4) of each of said branches of said guide channel, said top end stop being composed of continuous and integral first and second half parts and having an inner recessed surface engageable with said neck of said slider and an opposite chamfered surface engageable with the flaring side flange, each of said first and second half parts having an upper half portion and a lower half portion, respectively, of the inner recessed surface inwardly inclined with respect to said inner longitudinal edge of said one stringer tape, thus defining an obtuse angle therebetween, each of said first and second half parts having a maximum width (W1), (W2), as measured perpendicularly to the upper half portion and the lower half portion, respectively, of the inner recessed surface, equal to or slightly smaller than the width (W4) of each said branch of said guide channel; so that when said top end stop is received into the branch of the guide channel, the recessed surface of the top end stop engages the intermediate peak of the neck and also the distal end of the neck and the chamfered surface of the top end stop engages the inside surface of the flaring side flange of the slider, thus providing three-point supporting engagement between the neck and the flaring side flange.

2. A separable slide fastener according to claim 1, wherein said top end stop is composed of integral front and rear side portions disposed one on each side of said one stringer tape, one of said front and rear side portions having a maximum width smaller than the maximum width of the other side portion and substantially equal to the length of each of said fastener elements and having an outer flat surface substantially flush with a sole portion of a topmost one of said fastener elements.

3. A separable slide fastener according to claim 1, wherein said first half part of said top end stop has an arcuate front surface joined at opposite ends with said inner recessed surface and an outer side surface of said second half part by a pair of chamferred surfaces, respectively.

* * * * *